US005477106A

United States Patent [19]

Lednum et al.

[11] Patent Number: 5,477,106

[45] Date of Patent: Dec. 19, 1995

[54] CATHODE PLACEMENT IN A GAS DISCHARGE CLOSING SWITCH

[75] Inventors: Eugene E. Lednum; Murray J. Kennedy, both of Williamsport, Pa.

[73] Assignee: Litton Systems, Inc., Beverly Hills, Calif.

[21] Appl. No.: 99,055

[22] Filed: Jul. 29, 1993

[51] Int. Cl.[6] ..... H01J 17/48

[52] U.S. Cl. ..... 313/589

[58] Field of Search ..... 361/129, 130; 315/209 SL; 313/589

[56] References Cited

U.S. PATENT DOCUMENTS 2,573,373 10/1951 Wales, Jr. ..... 313/589

FOREIGN PATENT DOCUMENTS 769419 3/1957 United Kingdom ..... 39/1

*Primary Examiner*—Edward L. Coles, Sr.
*Assistant Examiner*—Jerome Grant, II
*Attorney, Agent, or Firm*—Nilsson, Wurst & Green

[57] ABSTRACT

In a closing switch having a control electrode and a cathode within a gas-filled cavity, the cathode has a distal portion spaced from the control electrode by a distance corresponding to the minimum breakdown voltage of the closing switch. Thus, the cathode is placed such that gas breakdown adjacent the distal portion occurs at a control voltage lower than the voltage required to initiate such breakdown adjacent the portion of the cathode closest to the control electrode.

12 Claims, 2 Drawing Sheets

CATHODE PLACEMENT IN A GAS DISCHARGE CLOSING SWITCH

BACKGROUND OF THE INVENTION

The present invention relates generally to gas discharge closing switches and, more particularly, to placement of a cathode in such a switch.

Gas discharge closing switches, such as thyratrons, are used to switch large voltages very quickly and with low power loss. A typical thyratron has an anode exposed to extremely high voltages and a cathode held at ground potential. A control electrode or "grid" is placed between the anode and the cathode to close the switch by providing a positive potential which draws electrons from the cathode and generates a dense, conducting plasma by an avalanche process. The onset of the plasma, referred to as "breakdown" of the gas within the device, occurs at a preselected voltage which depends solely on the pressure of the gas and the distance between the control electrode and the cathode. This relationship, known as Paschen's Law, is discussed in depth by Cobine, James D. in *Gaseous Conductors,* New York, McGraw-Hill Book Company (1941), pp 160–173, the teachings of which are hereby incorporated by reference.

Paschen's Law is often expressed graphically as a "Paschen Curve" relating the breakdown voltage ($V_B$) to the product of gas pressure (p) and gap distance (d). For a given cathode geometry, this curve has a minimum voltage ($V_{min}$) corresponding to a specific optimal value of p*d. The curve itself is empirically determined and is used in designing thyratrons. In this regard, it is often said by workers in the field that the cathode of a thyratron should be located at the Paschen Curve minimum of the device, meaning that the portion of the cathode closest to the control electrode should be spaced from the electrode by a distance which, for the specific gas pressure used, corresponds to the lowest point on the Paschen Curve.

By way of illustration, consider the device of FIG. 1 in which a thyratron 10 has a high voltage anode 12 and a grounded cathode 14 separated by a control electrode or "grid" 16. The distance between the control electrode and the closest portion of the cathode is designated $d_1$, and the distance between the control electrode and the most distant portion of the cathode is designated $d_2$. In this context, the curve of FIG. 2 illustrates the typical prior art placement of a thyratron cathode wherein the closest point of the cathode is spaced from the control electrode by the optimum distance $d_1$. The breakdown voltage ($V_B$) at the distance $d_1$ has a minimum value, $V_{min}$, which corresponds to the minimum of the Paschen Curve. The more distant points on the cathode, which are spaced from the control electrode by distances between $d_1$ and $d_2$, are displaced from the minimum of the curve and therefore have higher breakdown voltages. Under these conditions, breakdown is initiated at the near end of the cathode.

Unfortunately, Paschen Curves are not available for the complex geometries of many current thyratron cathodes. Cathode design based on Paschen's Law has therefore been somewhat imprecise in the past. In addition, when a thyratron breaks down at a point close to the control electrode, the resulting current has a shielding effect that repels current from more remote portions of the cathode. This precludes full utilization of the cathode surface and limits the current density of the device during breakdown.

Therefore, it is desirable in many applications to provide a cathode design for a closing switch which makes full use of Paschen's Law and permits more complete utilization of the cathode surface.

SUMMARY OF THE INVENTION

The cathode of the present invention is spaced from a control electrode in a manner causing breakdown of gas within the device to occur first at a location other than the point on the cathode closest to the control electrode. This is accomplished by positioning the cathode so that a more remote point on its surface is spaced from the control electrode by a distance corresponding to the minimum breakdown voltage of the Paschen Curve. The cathode is preferably arranged so that a point on a remote half of the cathode, and optimally the most distant point of the cathode, is located at the minimum breakdown distance. This causes current to flow first from remote areas of the cathode and increases current density during switch closure. Increased current density reduces the time for the switch to close and reduces undesirable "jitter".

Accordingly, a gas discharge closing switch of the present invention comprises: a housing having at least one cavity containing a gas at a preselected pressure; a control electrode within the cavity for applying a control voltage; a cathode structure located within the cavity and having a proximal portion and a distal portion relative to the control electrode; the cathode structure being spaced from the control electrode such that breakdown of the gas adjacent the distal portion occurs at a control voltage at least as low as, and preferably lower than, the voltage required to initiate such breakdown adjacent the proximal portion. In a preferred embodiment, the distal portion is spaced from the control electrode by a distance corresponding to the minimum breakdown voltage of the cavity at the preselected gas pressure. The cathode structure may also have a thermionic coating and may be disposed below the control electrode so that the distal portion of the cathode is at its lower end. In another aspect, the invention includes a method of manufacturing a gas discharge closing switch by positioning the cathode to initiate breakdown at a point remote from the control electrode.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE PREFERRED EMBODIMENTS

Figure 1:
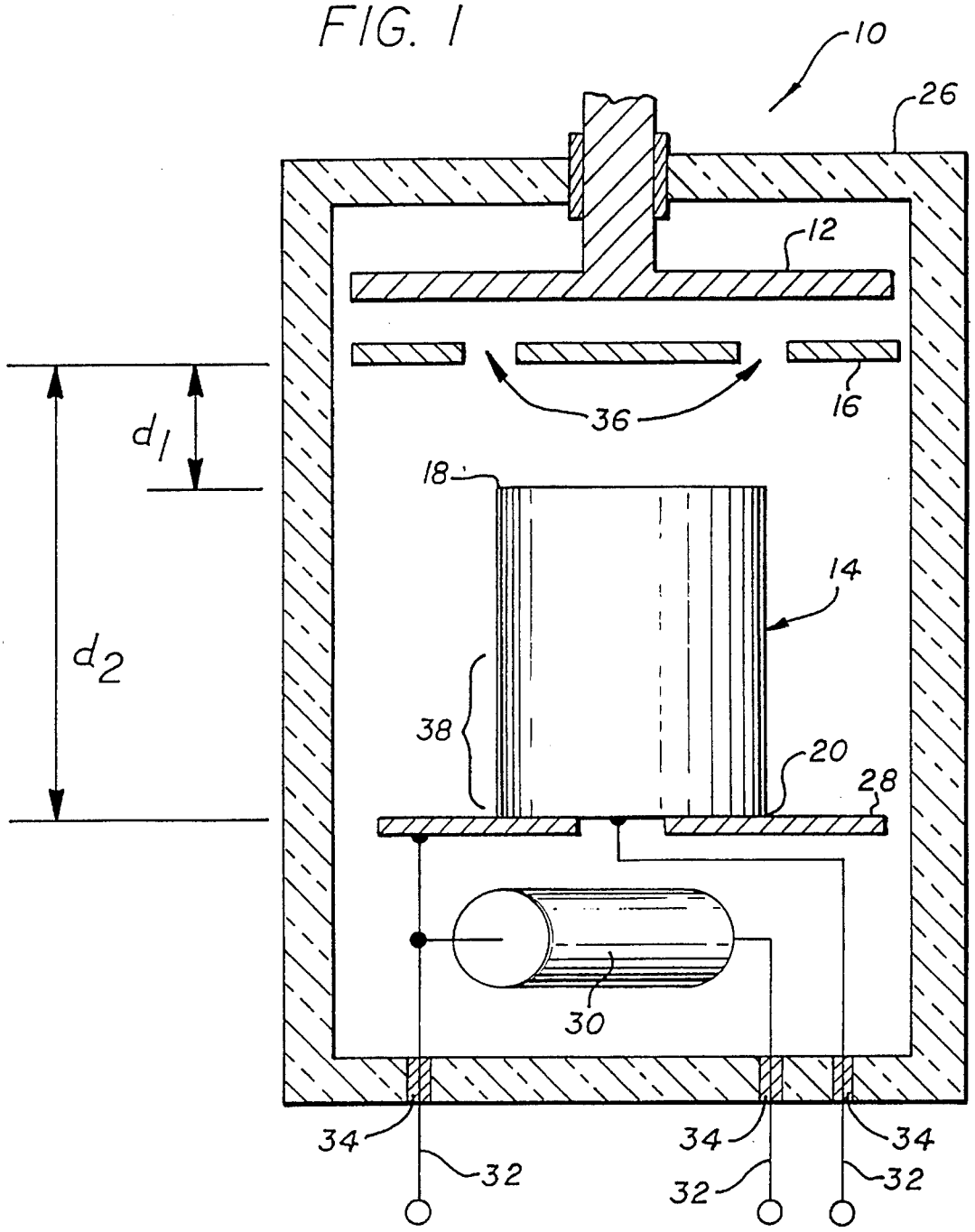
FIG. 1 is a partial cross-sectional view showing a thyratron constructed according to the present invention in partial cross-section.
Figure 2:
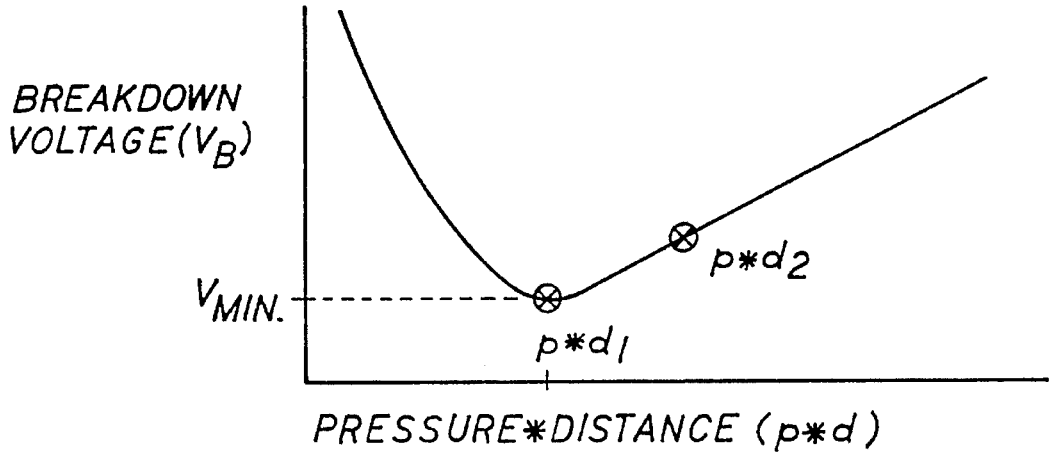
FIG. 2 PRIOR ART
FIG. 2 is a Paschen Curve for a thyratron bearing data corresponding to placement of the cathode structure in accordance with the teachings of the prior art.

Referring now to the drawings, specifically FIG. 1, one form of thyratron or other gas discharge closing switch 10 constructed in accordance with the teachings of the present invention has a high voltage anode 12 at its upper end, a cathode 14 beneath the anode, and a control electrode or "grid" 16 between the anode and the cathode. The cathode 14 is typically a cylindrical body extending from an upper end 18 to a lower end 20. The upper end 18 is spaced from the control electrode 16 by a first distance $d_1$ and the lower end 20 is spaced from the control electrode by a second, larger distance $d_2$. Whereas conventional thyratron design considerations would indicate that the upper end 18 should be spaced from the control electrode 16 by a distance corresponding to the minimum breakdown voltage of the device, as expressed by Paschen's Law, the thyratron 10 is constructed so that another, more remote portion of the cathode is located at the minimum breakdown distance. This causes breakdown of the gas within the cavity to occur initially at a point on the cathode body more remote from the control electrode 16 than the upper end 18. For purposes of this discussion, the portion of the cathode adjacent the upper end 18 is referred to as the "proximal" portion of the cathode, whereas any portion of the cathode more remote from the control electrode 16 is referred to as the "distal" portion. In one specific embodiment of the invention, the distal portion of the cathode is the lower end 20 of the cathode.

Figure 3:
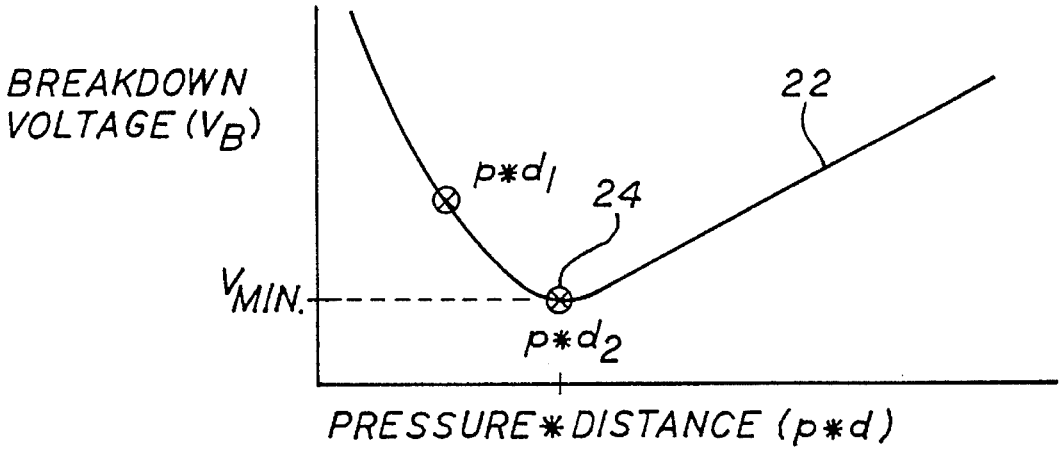
FIG. 3 is a Paschen Curve for the thyratron 10 of FIG. 1 bearing data corresponding to placement of the cathode in accordance to a preferred embodiment of the present invention.

Referring to FIG. 3, a Paschen Curve 22 for the thyratron 10 has a minimum 24 corresponding to a minimum breakdown voltage ($V_{min}$) achieved when the product of pressure and distance (p*d) has a preselected value. The Paschen Curve 22 increases monotonically on either side of the minimum over a range corresponding to the operating range of the thyratron 10. Because thyratrons typically operate at a preselected constant gas pressure, the minimum breakdown voltage ($V_{min}$) is achieved at a distance from the control electrode 16 which can be determined readily from the Paschen Curve. In the case depicted in FIG. 3, the minimum breakdown distance is $d_2$, the distance between the control electrode 16 and the lower end 20 of the cathode 14. It will be understood, however, that the cathode need not be placed so that the minimum breakdown voltage applies to its most remote end. Instead, the cathode can be placed to initiate breakdown at any desired portion of the cathode below the upper end 18. This is accomplished by appropriately positioning the cathode in the cavity when the device is manufactured.

As shown in FIG. 3, when the desired portion of the cathode 14 is located at the minimum breakdown distance $d_2$, the upper end 18 is shifted to the left of the minimum breakdown point on the Paschen Curve 22. A higher breakdown voltage ($V_B$) is then required to initiate a breakdown at the upper end.

The minimum breakdown voltage of the Paschen Curve is related to the conditions required to initiate the avalanche effect responsible for breakdown of the gaseous medium. One of these conditions is the number of collisions between electrons and gas molecules within the device. Whereas electrons emitted at the Paschen Curve minimum distance undergo an optimum number of collisions at a preselected gas pressure, those emitted from closer points on the cathode experience fewer collisions because they have a shorter distance to travel through the gas before reaching the control electrode. Unless the gas pressure is increased, an avalanche is not as likely to occur at distances shorter than the minimum breakdown distance. Electrons emitted from closer regions of the cathode therefore do not initiate breakdown until a higher voltage is reached ($V_B > V_{min}$). Similarly, electrons emitted from points on the cathode more remote than the minimum breakdown distance will not initiate breakdown because the voltage of the control electrode has less influence at greater distances. It is therefore more difficult to achieve avalanche conditions and a higher voltage is required.

Referring again to FIG. 1, the anode 12, the cathode 14 and a control electrode 16, are all located within a gas-tight housing 26 made of alumina or other electrically insulating material able to withstand high temperatures. The cathode 14 is preferably coated with any of a variety of known thermionic materials and contains a heater (not shown) for maintaining it at an operating temperature of approximately 800° C. The cathode housing is in electrical contact with a grounded base plate 28 which maintains the cathode at ground potential. A gas reservoir 30 beneath the base plate 28 fills the interior of the housing 20 with hydrogen or other gas capable of supporting a high density plasma. It is this plasma which provides the conductive path required for switch closure. The gas reservoir 30 is also electrically heated, typically using a power supply separate from that used to heat the cathode. Electrical power is supplied to the reservoir and the cathode heater through leads 32 which pass to the exterior of the housing 26 through feed-throughs 34 at the base of the housing.

In operation, a high positive voltage is applied to the anode 12 and the cathode 14 is grounded. The control electrode 16 is either grounded or maintained at a small negative potential to repel electrons emitted by the cathode 14 in the "open" condition of the switch. Substantially all of the voltage across the thyratron is therefore present between the anode 12 and the control electrode 16 in the open condition, but breakdown does not occur because of the absence of free carriers and the small spacing involved. When a positive pulse is applied to the control electrode 16, electrons are drawn from the cathode to ionize the gas within the chamber and create a plasma of highly energized gas species. The plasma diffuses up through the gaps 36 of the control electrode 16 to reach the anode. Because the anode is at a high potential, the charged particles within the gas are rapidly accelerated once they reach the gaps 36.

The time required for the plasma to diffuse through the region of the gaps 36 and to the anode 12 is known as the "commutation time" or the "anode delay time" of the thyratron. Commutation time is an extremely important parameter of a thyratron from the standpoint of efficiency. It is a measure not only of the time the switch takes to close, but also of switch closing losses which reduce tube lifetime and increase cooling requirements.

When a portion of the cathode 14 remote from the control electrode is placed at the minimum breakdown distance, the remote portion breaks down first in accordance with Paschen's Law. The bottom of the cathode is shielded to a degree after significant current begins to flow, but current flows first from the portion of the cathode located at the minimum breakdown distance. The upper end 18 thereafter experiences higher potentials and emits, as well. The total current density actually emitted during switch closure is therefore significantly greater in the structure of the claimed invention than in prior devices.

Although the teachings of the present invention apply whenever a cathode is positioned such that a point other than the closest end of the cathode is at the minimum breakdown distance, dramatic improvement in switching speed and smoothness is achieved when the minimum breakdown distance coincides with a point on the lower half 38 of the cathode (see FIG. 1). The most dramatic improvement occurs when the lower end 20 is disposed at the minimum breakdown distance. The entire area of the cathode then emits during breakdown. This arrangement is illustrated in the Paschen Curve 22 of FIG. 3.

Paschen's Law predicts the voltage at which breakdown and arcing occur in a gas-filled system, such as a gas discharge closing switch. A Paschen Curve provides a generalized relationship between the breakdown voltage ($V_B$) and the product of the gas pressure and the distance from the control electrode (p*d) for all pressures and distances within the operating range of a particular device. Paschen Curves strictly apply, however, only prior to switch closure and in the absence of thermionic emission because charged particles alter the potential distribution within the device. The values of breakdown voltage achieved with an unheated cathode are therefore not directly applicable to the case of thermionic emission because such emission provides electrons which facilitate breakdown. However, it has been found that a Paschen Curve derived for a cold cathode device provides an acceptable approximation of the behavior of a similarly constructed thermionic device.

In designing a gas discharge closing switch, such as the thyratron 10, it is advantageous to build a full size mock-up of the device with a glass housing so the point of initial breakdown can be seen. Tests at high fields can then be conducted either by holding the gas pressure constant and physically varying the distance between the cathode and the control electrode, or by fixing the distance and simply changing the gas pressure between measurements. The point on the cathode at which breakdown first occurs can be recorded for each distance or pressure value. Based on the data obtained, a curve can be plotted for use in designing actual devices. In constructing such a device, a cathode is positioned so that a specific distal region of its outer surface is located precisely at the minimum breakdown distance from the control electrode. In one exemplary embodiment, the specific distal region located at the point of minimum breakdown is at the lower end 20 of the cathode, as mentioned above. In other embodiments, depending upon a variety of design factors, such as the particular type of gas discharge closing switch used and its design variables, the specific distal region may be located away from the lower end 20.

From the above, it can be seen that the disclosed positioning of a cathode in a gas-discharge closing switch increases the current density within the device to facilitate plasma formation and reduce commutation time and jitter.

While certain specific embodiments of the invention have been disclosed as typical, the invention is not limited to these particular forms, but rather is applicable broadly to all such variations as fall within the scope of the appended claims. For example, the teachings of the invention apply to all known thyratron geometries, and other gas discharge closing switches, regardless of how complex they might be.

What is claimed is:

1. A gas discharge closing switch comprising:

a housing containing a gas at a preselected pressure;

a control electrode within the housing for applying a control voltage to initiate breakdown of said gas;

a cathode structure located within the housing and having a proximal portion relative to the control electrode;

the cathode structure disposed relative to the control electrode to initiate said breakdown at a distal portion of the cathode structure more remote from the control electrode than said proximal portion; and the distal portion of the cathode structure spaced from the control electrode by a distance corresponding to the minimum breakdown voltage within the closing switch at said preselected gas pressure.

2. A gas discharge closing switch comprising:

a housing containing a gas at a preselected pressure;

a control electrode within the housing for applying a control voltage to initiate breakdown of said gas;

a cathode structure located within the housing and having a proximal portion and a distal portion relative to the control electrode;

the distal portion of the cathode structure spaced from the control electrode by a distance corresponding to the minimum breakdown voltage within the closing switch at said preselected gas pressure.

3. The gas discharge closing switch of claim 2 wherein:

the minimum breakdown voltage within the housing corresponds to the minimum of a Paschen curve.

4. A gas discharge closing switch comprising:

housing means containing gas at a preselected pressure;

control electrode means within the housing for applying a control voltage;

cathode means located within the housing and having a proximal portion and a distal portion relative to the control electrode means;

the cathode means spaced from the control electrode means such that breakdown of said gas occurs adjacent said distal portion at a control voltage lower than the control voltage required to initiate such breakdown adjacent the proximal portion of the cathode means.

5. A gas discharge closing switch comprising:

a housing containing a gas at a preselected pressure;

a control electrode within the housing for applying a control voltage;

a cathode structure located within the housing and having a proximal portion and a distal portion relative to the control electrode;

the cathode structure spaced from the control electrode such that breakdown of said gas occurs adjacent the distal portion of the cathode structure before such breakdown is initiated at the proximal portion of the cathode structure as the control voltage is increased.

6. The gas discharge closing switch of claim 5 wherein:

the distal portion of the cathode structure is spaced from the control electrode by a distance corresponding to the minimum breakdown voltage of the closing switch at said preselected gas pressure.

7. A method of manufacturing a gas discharge closing switch comprising the steps of:

providing a housing for containing a gas at a preselected pressure;

providing a control electrode within the housing;

providing a cathode structure within the housing, the cathode structure having a proximal portion and a distal portion relative to the control electrode;

locating the cathode structure within the housing such that breakdown of the gas adjacent the distal portion of the cathode structure occurs at a control voltage lower than the control voltage required to initiate such breakdown adjacent the proximal portion of the cathode structure.

8. The manufacturing method of claim 6 wherein the step of locating the cathode structure within the housing further comprises:

positioning the cathode structure so that the distal portion is spaced from the control electrode by a distance corresponding to the minimum breakdown voltage of the closing switch at said preselected gas pressure.

9. The manufacturing method of claim 6 wherein:

the cathode structure is positioned in the housing with said distal portion located at an end of the cathode structure opposite to the control electrode.

10. A gas discharge closing switch comprising:

a housing containing a gas at a preselected pressure;

a control electrode within the housing for applying a control voltage to initiate breakdown of said gas; and a cathode structure located within the housing and beneath the control electrode, the cathode structure having an upper half and a lower half;

the cathode structure spaced from the control electrode such that said breakdown occurs adjacent the lower half of the cathode structure at a control voltage lower than the control voltage required to initiate such breakdown adjacent the upper half of the cathode structure.

11. A gas discharge closing switch comprising:

a housing containing a gas at a preselected pressure;

a control electrode within the housing for applying a control voltage to initiate breakdown of said gas; and a cathode structure located within the housing and beneath the control electrode, the cathode structure having a proximal portion and a distal portion relative to the control electrode, the distal portion being adjacent a lower end of the cathode structure;

the cathode structure spaced from the control electrode such that said breakdown occurs adjacent the distal portion of the cathode structure at a control voltage lower than the control voltage required to initiate such breakdown adjacent the proximal portion of the cathode structure.

12. A gas discharge closing switch comprising:

a housing containing a gas at a preselected pressure;

a control electrode within the housing for applying a control voltage to initiate breakdown of said gas;

a cathode structure having a thermionic coating and located within the housing, the cathode structure having a proximal portion and a distal portion relative to the control electrode, the distal portion being adjacent a lower end of the cathode structure;

the cathode structure spaced from the control electrode such that said breakdown occurs adjacent the distal portion of the cathode structure at a control voltage lower than the control voltage required to initiate such breakdown adjacent the proximal portion of the cathode structure.

* * * * *